US008657349B2

(12) United States Patent
Konchan et al.

(10) Patent No.: US 8,657,349 B2
(45) Date of Patent: Feb. 25, 2014

(54) LATCH ASSEMBLY FOR A VEHICLE

(75) Inventors: Jeffrey L. Konchan, Romeo, MI (US); Steven Bauer, Clarkston, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 213 days.

(21) Appl. No.: 13/109,050

(22) Filed: May 17, 2011

(65) Prior Publication Data

US 2012/0291358 A1 Nov. 22, 2012

(51) Int. Cl.
*E05C 3/12* (2006.01)

(52) U.S. Cl.
USPC ..... 292/216

(58) Field of Classification Search
CPC ..... E05B 85/243; E05B 47/0002
USPC ..... 292/194, 195, 198, 203, 210, 341.17, 292/216, 201, DIG. 23, 336.3
See application file for complete search history.

(56) References Cited

U.S. PATENT DOCUMENTS

| | | | | | |
|---|---|---|---|---|---|
| 3,317,229 | A | * | 5/1967 | Scarpace | 292/216 |
| 3,773,368 | A | * | 11/1973 | Atwood et al. | 292/48 |
| 4,585,261 | A | * | 4/1986 | Adams et al. | 292/216 |
| 4,756,563 | A | * | 7/1988 | Garwood et al. | 292/216 |
| 4,838,588 | A | * | 6/1989 | Hayakawa et al. | 292/216 |
| 4,913,477 | A | * | 4/1990 | Watanuki et al. | 292/216 |
| 6,007,118 | A | * | 12/1999 | Arabia et al. | 292/216 |
| 6,042,160 | A | * | 3/2000 | Hamada et al. | 292/216 |
| 6,679,531 | B2 | * | 1/2004 | Rogers et al. | 292/216 |

* cited by examiner

*Primary Examiner* — Thomas Beach
*Assistant Examiner* — Nathan Cumar
(74) *Attorney, Agent, or Firm* — Quinn Law Group, PLLC

(57) ABSTRACT

A latching system includes a striker defining an outer width and a latch assembly. The latch assembly includes a support structure including a first side plate, a second side plate spaced from the first side plate, and a top plate fixedly attached to and extending between the first side plate and the second side plate. The first side plate and the second side plate are spaced from each other a separation distance that is greater than the outer width of the striker such that the outer width of the striker is completely disposed between the first side plate and the second side plate when the latch assembly is in a lock position.

16 Claims, 2 Drawing Sheets

LATCH ASSEMBLY FOR A VEHICLE

TECHNICAL FIELD

The invention generally relates to a latch assembly for a door of a vehicle.

BACKGROUND

Latch assemblies for a door of a vehicle are typically configured to include a latching element, often referred to as a fork bolt or a ratchet, which may engage a striker in locking engagement. The latch assembly is attached to the door, and the striker is attached to a body of the vehicle. Locking engagement between the latching element and the striker provides a latching force that secures the door relative to the body of the vehicle. The latching force must be sufficient to latch the door to the body under nominal or ordinary loading conditions, as well as during higher impact loading conditions such as may be sustained in a vehicle impact event. Accordingly, the latch assembly must include sufficient strength to resist or minimize deformation and/or bending during an impact event in order to maintain the locking engagement between the latching element and the striker.

SUMMARY

A latching system is provided. The latching system includes a striker defining an outer width, and a latch assembly. The latch assembly includes a support structure including a first side plate and a second side plate. The second side plate is spaced from the first side plate a separation distance that is greater than the outer width of the striker. The latch assembly further includes a latch mechanism disposed between the first side plate and the second side plate. The latch mechanism is moveable between a lock position and a release position. The lock position is configured for engaging the striker in locking engagement. The release position is configured for disengaging the striker. The outer width of the striker is completely disposed between the first side plate and the second side plate when in locking engagement with the latch mechanism.

A vehicle is also provided. The vehicle includes a body, and a door pivotably mounted to the body. The door is moveable between an open position and a closed position. A striker is mounted to one of the door and the body. The striker defines an outer width. A latch assembly is mounted to one of the door and the body. The latch assembly is configured for engaging the striker in locking engagement when the door is in the closed position to secure the door relative to the body. The latch assembly includes a support structure. The support structure includes a first side plate and a second side plate spaced from the first side plate a separation distance. The separation distance is greater than the outer width of the striker. The latch assembly further includes a latch mechanism disposed between the first side plate and the second side plate. The latch mechanism is moveable between a lock position and a release position. The lock position is configured for engaging the striker in locking engagement. The release position is configured for disengaging the striker. The outer width of the striker is completely disposed between the first side plate and the second side plate when in locking engagement with the latch mechanism.

A latch assembly for a door of a vehicle is also provided. The latch assembly includes a support structure. The support structure includes a first side plate, a second side plate and a top plate. The second side plate is spaced from the first side plate a separation distance, with the top plate extending between and fixedly attached to each of the first side plate and the second side plate. A latch mechanism is disposed between the first side plate and the second side plate. The latch mechanism is moveable between a lock position and a release position. The lock position is configured for engaging a striker in locking engagement. The release position is configured for disengaging the striker. The separation distance between the first side plate and the second side plate is configured for receiving an outer width of the striker such that the outer width of the striker is completely disposed between the first side plate and the second side plate when the latch assembly is in the lock position.

Accordingly, because the outer width of the striker is completely disposed between the first side plate and the second side plate, a perimeter of each of the first side plate and the second side plate may define a solid rectangular shape, e.g., no cut-outs for receiving the striker therethrough, thereby increasing the strength of the latch assembly. Additionally, the top plate, which extends between the first side plate and the second side plate further increases the strength of the latch assembly. Additionally, the fork bolt is positioned relative to the top plate to minimize a gap between the top plate and the fork bolt when the fork bolt is in the lock position, while still allowing sufficient space for the fork bolt to rotate between the lock position and the release position. The minimized gap between the fork bolt and the top plate helps ensure that the fork bolt may not slip out of locking engagement with the fork bolt between the fork bolt and the top plate in the event the latch assembly is deformed.

The above features and advantages and other features and advantages of the present invention are readily apparent from the following detailed description of the best modes for carrying out the invention when taken in connection with the accompanying drawings.

DETAILED DESCRIPTION

Referring to the Figures, wherein like numerals indicate like parts throughout the several views, a latching system is shown generally at 20. Throughout this specification, terms such as "above," "below," "upward," "downward," "inner," "outer," et cetera, are used descriptively of the figures, and do not represent limitations on the scope of the invention, as defined by the appended claims.

Figure 1:
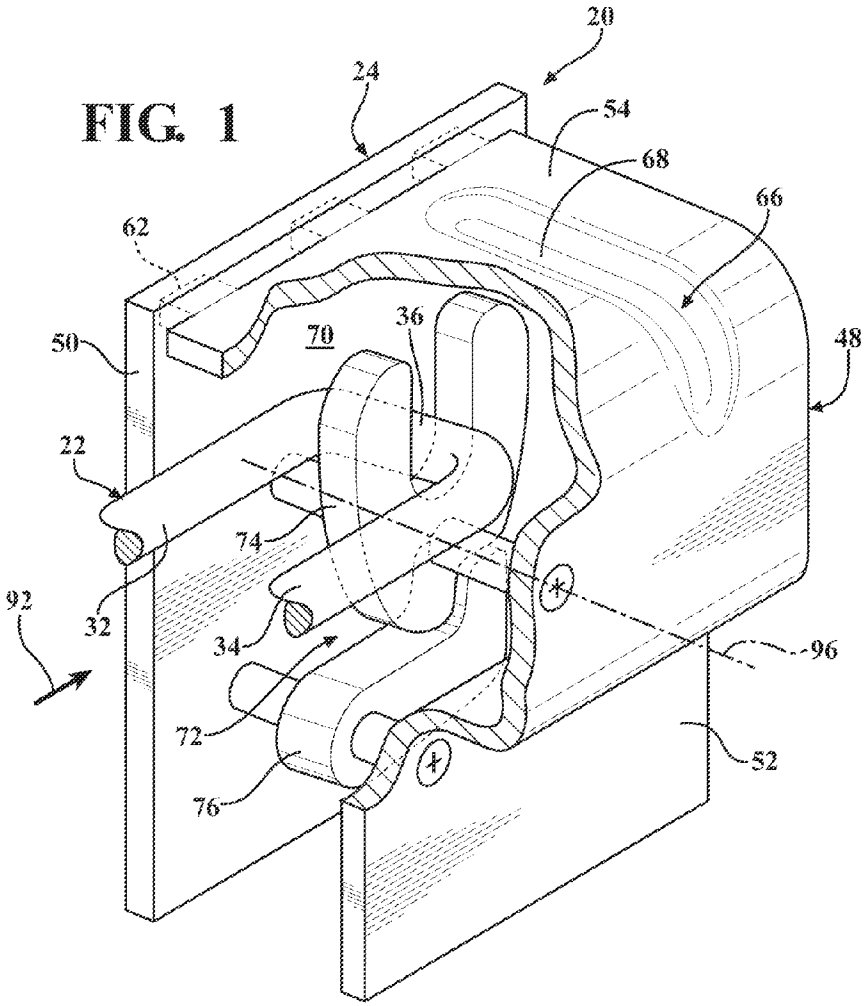
FIG. 1 is a schematic perspective view of a latching system.
Figure 4:
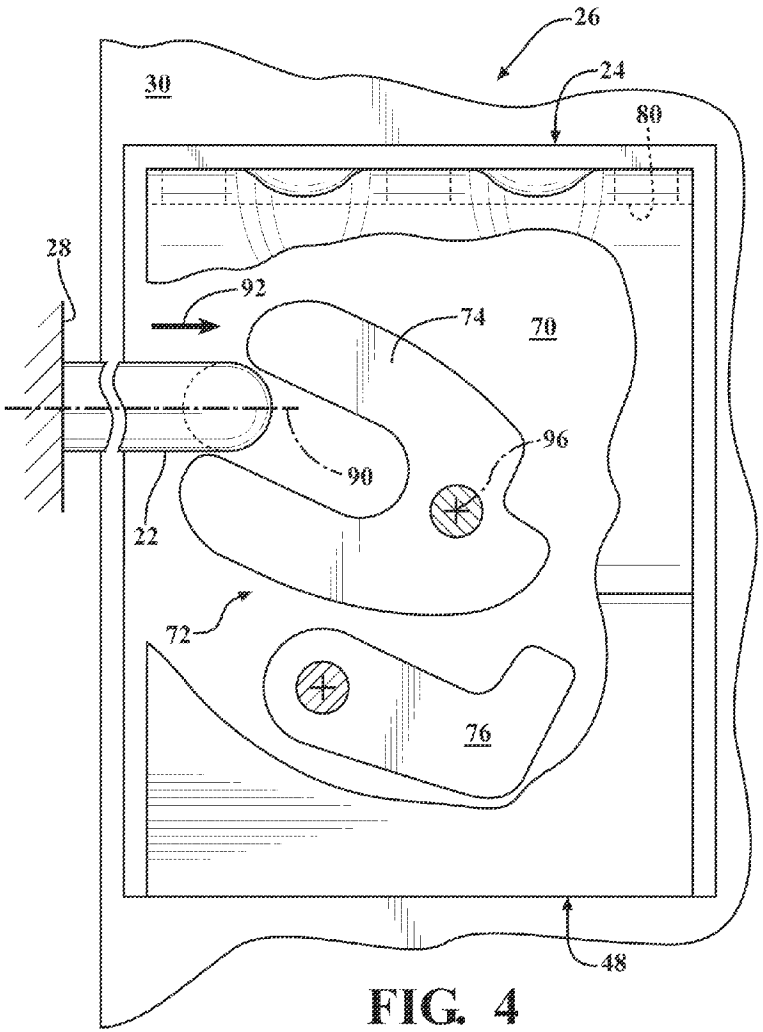
FIG. 4 is a schematic plan view of the vehicle showing the latching system in a release position.
Figure 3:
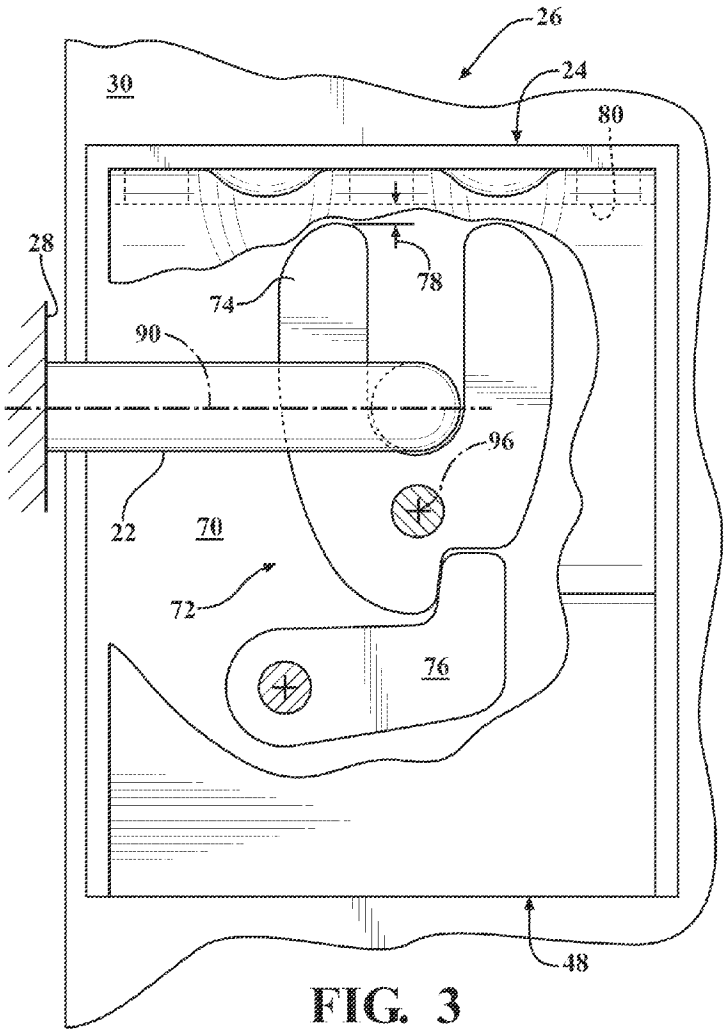
FIG. 3 is a schematic plan view of a vehicle showing the latching system in a lock position.

Referring to FIG. 1, the latching system 20 includes a striker 22 and a latch assembly 24. Referring also to FIGS. 3 and 4, the latching system 20 is shown incorporated into a vehicle 26. The vehicle 26 includes a body 28, and a door 30 pivotably mounted to the body 28. The door 30 is moveable between an open position shown in FIG. 4 and a closed position shown in FIG. 3. While the latching system 20 is shown incorporated into the vehicle 26, it should be appreciated that the latching system 20 may be incorporated into some other non-automotive manufacture.

As shown in FIGS. 3 and 4, the striker 22 is mounted to the body 28, and the latch assembly 24 is mounted to the door 30. However, it should be appreciated that the relative positions of the striker 22 and the latch assembly 24 may be reversed, with the striker 22 mounted to the door 30, and the latch assembly 24 mounted to the body 28. The latch assembly 24 is configured for engaging the striker 22 in locking engagement when the door 30 is in the closed position to secure the door 30 relative to the body 28.

As best shown in FIG. 1, the striker 22 includes a first extension bar 32, a second extension bar 34 and a cross bar 36. The second extension bar 34 is parallel with and spaced from the first extension bar 32, with the cross bar 36 extending between the first extension bar 32 and the second extension bar 34. The first extension bar 32, the second extension bar 34 and the cross bar 36 are all disposed along a common plane 90, shown in FIG. 2, and are arranged to define a generally U-shaped striker 22 that is disposed on the common plane 90. As shown in FIG. 4, the latch assembly 24 is moveable relative to the striker 22 along a direction of travel 92 that is parallel with the common plane 90 and perpendicular to the cross bar 36 of the striker 22. Referring to FIGS. 3 and 4, each of the first extension bar 32 and the second extension bar 34 include a first end that is attached to the body 28 of the vehicle 26, and a second end that is attached to the cross bar 36. Preferably, the striker 22 is manufactured from round metal stock, and is formed from a single unitary piece of metal. Accordingly, the first extension bar 32, the second extension bar 34 and the cross bar 36 are preferably integrally formed together. It should be appreciated, however, that the striker 22 may be shaped, formed and/or manufactured in some other manner not shown or described herein, and that the scope of the invention is not limited to the shape of the striker 22 described and shown herein, nor to the manner of manufacturing the striker 22 as described herein.

Figure 2:
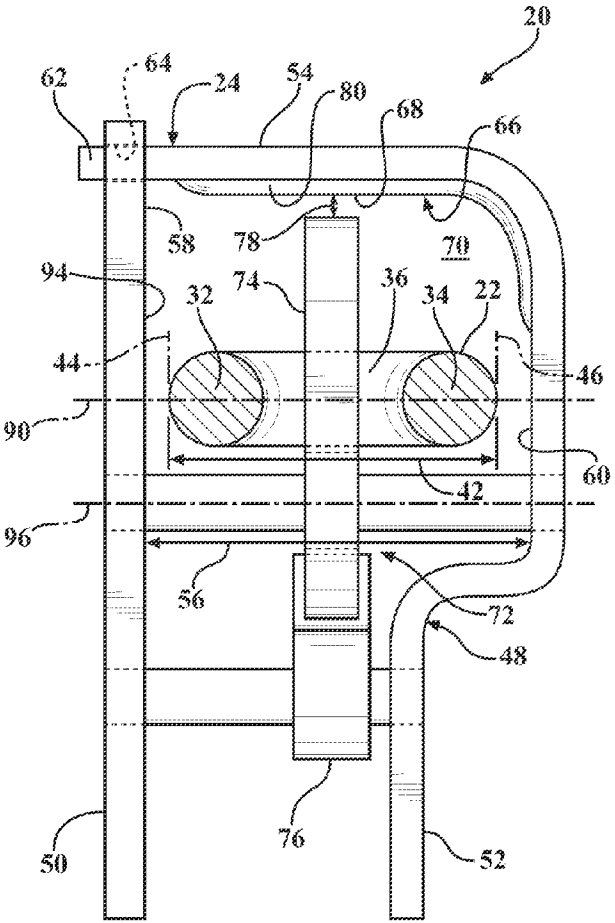
FIG. 2 is a schematic cross sectional view of the latching system.

Referring to FIG. 2, the striker 22 defines an outer width 42. The outer width 42 of the striker 22 is measured between an outer edge 44 of the first extension bar 32 and an outer edge 46 of the second extension bar 34, on the common plane 90 on which the striker 22 lies. The outer width 42 of the striker 22 therefore defines the maximum distance between the outer edges 44, 46 of the first extension bar 32 and the second extension bar 34 respectively, measured perpendicularly relative to the first extension bar 32 and the second extension bar 34.

Referring to FIGS. 1 and 2, the latch assembly 24 includes a support structure 48. The support structure 48 includes a first side plate 50, a second side plate 52 and a top plate 54. The first side plate 50 and the second side plate 52 are parallel with each are, and are spaced from each other a separation distance 56. As shown in FIG. 2, the common plane 90 extends through the first side plate 50 and the second side plate 52. The first side plate 50 and the second side plate 52 define an opening 94 therebetween for receiving the striker 22 therethrough along the direction of travel 92. The striker 22 moves along the direction of travel 92, parallel with and between the first side plate 50 and the second side plate 52, through the opening 94. The width of the opening 94 is defined by the separation distance 56. The separation distance 56 is the perpendicular distance between an inner surface 58 of the first side plate 50 and an inner surface 60 of the second side plate 52. The top plate 54 extends between the first side plate 50 and the second side plate 52. The top plate 54 is fixedly attached to each of the first side plate 50 and the second side plate 52. The top plate 54 may be attached to the first side plate 50 and the second side plate 52 in any suitable manner. Additionally, the top plate 54 may be integrally formed with at least one of the first side plate 50 and the second side plate 52. As shown, the top plate 54 is integrally formed with the second side plate 52 and fixedly attached to the first side plate 50. As shown, the top plate 54 includes a plurality of projections 62 that extend through a plurality of apertures 64 in the first side plate 50 that correspond with the plurality of projections 62 on the top plate 54. Once the projections 62 are inserted through the apertures 64, the projections 62 may be deformed or otherwise secured to the first side plate 50 to fixedly attach the top plate 54 to the first side plate 50. It should be appreciated that the top plate 54 may be attached to the first side plate 50 and the second side plate 52 in some other manner not shown or described herein.

The top plate 54 may include at least one planar deformation 66. The planar deformation 66 is a geometric structure of the top plate 54 that is configured for increasing a bending strength of the top plate 54 and of the support structure 48 as a whole. Increased strength of the support structure 48 increases the resistance to bending and/or deformation of the support structure 48 during an impact event. As shown, the top plate 54 is disposed along a plane and the at least one planar deformation 66 includes at least one ridge 68 formed into the top plate 54 and extending away from the plane of the top plate 54. As shown, the ridge 68 extends downward into an interior space 70 defined between the first side plate 50, the second side plate 52 and the top plate 54. However, it should be appreciated that the ridge 68 may alternatively extend upward away from the top plate 54. Additionally, it should be appreciated that the planar deformation 66 may include some other shape, and may be configured and/or orientated in some other manner not shown or described herein.

The separation distance 56 of the support structure 48, between the first side plate 50 and the second side plate 52, is greater than the outer width 42 of the striker 22. As such, the outer width 42 of the striker 22 may be completely disposed between the first side plate 50 and the second side plate 52. Accordingly, the first extension bar 32, the second extension bar 34 and the cross bar 36 may be disposed between the first side plate 50 and the second side plate 52 when in the lock position. Because the entire outer width 42 of the striker 22 may be disposed between the first side plate 50 and the second side plate 52, neither the first side plate 50 nor the second side plate 52 need define a cut-out for receiving the striker 22 therein. Therefore, the first side plate 50 and the second side plate 52 may each include a perimeter that defines a complete and uninterrupted rectangular shape. The complete and uninterrupted rectangular shape of each of the first side plate 50 and the second side plate 52 further increases the resistance of the support structure 48 to bending and/or deformation by eliminating stress points in the first side plate 50 and the second side plate 52.

As best shown in FIGS. 3 and 4, the latch assembly 24 further includes a latch mechanism 72. The latch mechanism 72 is disposed between the first side plate 50 and the second side plate 52. The latch mechanism 72 is moveable between a lock position, shown in FIG. 3, and a release position, shown in FIG. 4. The lock position is configured for engaging the striker 22 in locking engagement. The release position is configured for disengaging the striker 22. Accordingly, the outer width 42 of the striker 22, including the first extension bar 32, the second extension bar 34 and the cross bar 36, is completely disposed between the first side plate 50 and the second side plate 52 when the striker 22 is in locking engagement with the latch mechanism 72.

The latch mechanism 72 may include any suitable mechanism capable of selectively and releasably grasping the striker 22 and securing the striker 22 relative to the support structure 48 until released. For example, a common latch mechanism 72 includes a fork bolt 74 that is rotatable about an axis 96 between the lock position and the release position, with a pawl 76 that is in engagement with the fork bolt 74 and is remotely actuated to move the fork bolt 74 between the lock position and the release position. As best shown in FIG. 2, the axis 96 that the fork bolt 74 rotates about is disposed substantially perpendicular to the first side plate 50 and the second side plate 52, and is disposed substantially parallel with the common plane 90. When disposed in the lock position, the fork bolt 74 directly contacts and engages the cross bar 36 in locking engagement. The fork bolt 74 is disposed substantially parallel with each of the first side plate 50 and the second side plate 52. However, it should be appreciated that other types and/or configurations of the latch mechanism 72 are suitable for use in the latch assembly 24.

As shown in FIG. 3, when in the lock position, the fork bolt 74 is disposed adjacent the top plate 54 with a gap 78 separating the fork bolt 74 from an inner surface 80 of the top plate 54. The fork bolt 74 is positioned relative to the top plate 54 to minimize the gap 78 between the top plate 54 and the fork bolt 74 when the fork bolt 74 is in the lock position, while still allowing sufficient space for the fork bolt 74 to rotate between the lock position and the release position. The minimized gap 78 between the fork bolt 74 and the top plate 54 helps ensure that the fork bolt 74 may not slip out of locking engagement with the fork bolt 74 between the fork bolt 74 and the top plate 54 in the event the latch assembly 24 is deformed.

While the best modes for carrying out the invention have been described in detail, those familiar with the art to which this invention relates will recognize various alternative designs and embodiments for practicing the invention within the scope of the appended claims.

The invention claimed is:

1. A latching system comprising:

a striker including a first extension bar, a second extension bar parallel with and spaced from the first extension bar, and a cross bar extending between the first extension bar and the second extension bar, with the first extension bar, the second extension bar, and the cross bar all disposed along a common plane to define a generally U-shaped striker disposed on the common plane;

wherein the striker defines an outer width measured on the common plane, between an outer edge of the first extension bar and an outer edge of the second extension bar;

a latch assembly moveable relative to the striker along a direction of travel that is parallel with the common plane and perpendicular to the cross bar of the striker, the latch assembly including:

a support structure including a first side plate and a second side plate, wherein the first side plate and the second side plate are parallel with each other and are spaced from each other a separation distance that is greater than the outer width of the striker;

wherein the first side plate and the second side plate define an opening therebetween for receiving the striker therethrough such that the striker moves parallel with and between both the first side plate and the second side plate;

a latch mechanism disposed between the first side plate and the second side plate and moveable between a lock position configured for engaging the striker in locking engagement and a release position configured for disengaging the striker;

wherein the latch mechanism includes a fork bolt rotatable about an axis between the lock position and the release position, with the fork bolt directly contacting the cross bar in locking engagement when disposed in the lock position;

wherein the axis that the fork bolt rotates about is perpendicular to the first side plate and the second side plate, and parallel with the common plane; and wherein the outer width of the striker is completely disposed between the first side plate and the second side plate when in locking engagement with the latch mechanism.

2. A latching system as set forth in claim 1 wherein the first extension bar, the second extension bar and the cross bar are disposed between the first side plate and the second side plate when in the lock position.

3. A latching system as set forth in claim 1 wherein the support structure further includes a top plate extending between the first side plate and the second side plate.

4. A latching system as set forth in claim 3 wherein the top plate is integrally formed with at least one of the first side plate and the second side plate.

5. A latching system as set forth in claim 3 wherein the top plate is fixedly attached to each of the first side plate and the second side plate.

6. A latching system as set forth in claim 3 wherein the top plate includes at least one planar deformation configured for increasing a bending strength of the support structure.

7. A latching system as set forth in claim 6 wherein the top plate is disposed along a plane and the at least one planar deformation includes at least one ridge formed into the top plate and extending away from the plane of the top plate.

8. A latching system as set forth in claim 1 wherein the fork bolt is disposed adjacent the top plate when in the lock position to minimize a gap between the top plate and the fork bolt when the fork bolt is in the lock position.

9. A latching system as set forth in claim 1 wherein the first side plate and the second side plate each include a perimeter that defines a rectangular shape.

10. A vehicle comprising:

a body;

a door pivotably mounted to the body for movement between an open position and a closed position;

a striker mounted to one of the body and the door, and including a first extension bar, a second extension bar parallel with and spaced from the first extension bar, and a cross bar extending between the first extension bar and the second extension bar, with the first extension bar, the second extension bar, and the cross bar disposed along a common plate to define a generally U-shaped striker disposed on the common plane, wherein the striker defines an outer width measured on the common plane, between an outer edge of the first extension bar and an outer edge of the second extension bar; and a latch assembly mounted to one of the body and the door, moveable relative to the striker along a direction of travel that is parallel with the common plate and perpendicular to the cross bar of the striker, and configured for engaging the striker in locking engagement when the door is in the closed position to secure the door relative to the body, wherein the latch assembly includes:

a support structure including a first side plate and a second side plate, wherein the first side plate and the second side plate are parallel with each other, and are spaced from each other a separation distance that is greater than the outer width of the striker;

wherein the first side plate and the second side plate define an opening therebetween for receiving the striker therethrough, such that the striker moves parallel with and between both the first side plate and the second side plate;

a latch mechanism disposed between the first side plate and the second side plate and moveable between a lock position configured for engaging the striker in locking engagement and a release position configured for disengaging the striker;

wherein the latch mechanism includes a fork bolt rotatable about an axis between a lock position and a release position, with the fork bolt directly contacting the cross bar in locking engagement when disposed in the lock position;

wherein the axis that the fork bolt rotates about is perpendicular to the first side plate and the second side plate, and parallel with the common plane; and wherein the outer width of the striker is completely disposed between the first side plate and the second side plate when in locking engagement with the latch mechanism.

11. A latching system as set forth in claim 10 wherein the support structure further includes a top plate extending between the first side plate and the second side plate.

12. A latching system as set forth in claim 11 wherein the top plate is integrally formed with at least one of the first side plate and the second side plate.

13. A latching system as set forth in claim 11 wherein the top plate is fixedly attached to each of the first side plate and the second side plate.

14. A latching system as set forth in claim 10 wherein the first extension bar, the second extension bar and the cross bar are disposed between the first side plate and the second side plate when in the lock position.

15. A latching system as set forth in claim 1 wherein neither of the first side plate and the second side plate define a cut-out for receiving the striker therethrough.

16. A latching system as set forth in claim 10 wherein neither of the first side plate and the second side plate define a cut-out for receiving the striker therethrough.

* * * * *